US012655782B2

(12) United States Patent
Klein

(10) Patent No.: US 12,655,782 B2
(45) Date of Patent: Jun. 16, 2026

(54) MIXER ARRANGEMENT FOR MIXING AN INJECTION MEDIUM WITH THE EXHAUST GAS OF AN INTERNAL COMBUSTION ENGINE

(71) Applicants: DEUTZ Aktiengesellschaft, Cologne (DE); Deere & Company, Moline, IL (US)

(72) Inventor: Christoph Klein, Rösrath (DE)

(73) Assignees: Deutz Aktiengesellschaft, Cologne (DE); Deere & Company, Moline, IL (US)

( * ) Notice: Subject to any disclaimer, the term of this patent is extended or adjusted under 35 U.S.C. 154(b) by 0 days.

(21) Appl. No.: 18/890,869

(22) Filed: Sep. 20, 2024

(65) Prior Publication Data

US 2025/0101896 A1 Mar. 27, 2025

(30) Foreign Application Priority Data

Sep. 22, 2023 (DE) ..... 102023125731.5

(51) Int. Cl.
*F01N 3/20* (2006.01)

(52) U.S. Cl.
CPC ..... *F01N 3/206* (2013.01); *F01N 3/208* (2013.01); *F01N 2240/20* (2013.01); *F01N 2610/02* (2013.01); *F01N 2610/1453* (2013.01)

(58) Field of Classification Search
CPC ..... F01N 3/206; F01N 3/208; F01N 2240/20; F01N 2610/02; F01N 2610/1453
See application file for complete search history.

(56) References Cited

U.S. PATENT DOCUMENTS

| | | | | |
|---|---|---|---|---|
| 1,035,782 | A * | 8/1912 | Fowler | F21V 21/02 248/343 |
| 6,444,177 | B1 * | 9/2002 | Muller | B01F 23/2132 422/177 |
| 8,327,829 | B2 * | 12/2012 | Keidel | F01N 13/18 60/303 |
| 8,800,275 | B2 * | 8/2014 | Crandell | B01F 23/2132 60/303 |
| 9,896,981 | B2 * | 2/2018 | Kapale | F01N 13/1855 |
| 10,967,334 | B2 * | 4/2021 | Quan | B01D 53/9431 |
| 11,391,193 | B2 * | 7/2022 | Arunachalam | F01N 3/24 |
| 11,725,563 | B2 | 8/2023 | Geant et al. | |

(Continued)

FOREIGN PATENT DOCUMENTS

| | | | |
|---|---|---|---|
| DE | 202021106123 | U1 | 2/2022 |
| DE | 102022121551 | A1 | 3/2023 |
| EP | 3808949 | A1 | 4/2021 |

*Primary Examiner* — Matthew T Largi
(74) *Attorney, Agent, or Firm* — Davidson Kappel LLC

(57) ABSTRACT

A mixer assembly, for mixing an injection medium with the exhaust gas of an internal combustion engine, includes an exhaust gas guide section into the interior of which the exhaust gas of the internal combustion engine can be guided and an injector which is fastened to an outside of the exhaust gas guide section. The exhaust gas guide section has an injection opening which extends along an injection axis and through which the injection medium can be injected from the injector into the interior of the exhaust gas guide section. A first recess is formed on the outside of the exhaust gas guide section. The first recess is arranged in overlap with the injector in a direction parallel to the injection axis. The injector is spaced from the outside of the exhaust gas guide section in this direction.

18 Claims, 8 Drawing Sheets

(56) References Cited

U.S. PATENT DOCUMENTS

2008/0236147 A1* 10/2008 Van Vuuren ..... F01N 3/2066 60/286
2011/0274590 A1* 11/2011 Floyd ..... F01N 3/2066 422/177
2013/0164182 A1* 6/2013 Iijima ..... F01N 3/208 261/76
2013/0219871 A1* 8/2013 Crandell ..... F01N 3/2066 60/295
2014/0054394 A1* 2/2014 Bugos ..... F01N 3/2066 239/132.3
2014/0196441 A1* 7/2014 Katou ..... B01F 25/3131 60/286
2014/0237998 A1* 8/2014 Fahrenkrug ..... F01N 3/2066 123/470
2014/0331655 A1* 11/2014 Crandell ..... B01F 25/313 60/295
2015/0252711 A1* 9/2015 Muruganantham ..... F01N 13/1805 29/428
2015/0285200 A1* 10/2015 Niaz ..... F01N 13/009 123/470
2016/0076425 A1* 3/2016 Goffe ..... B01F 25/43195 60/295
2016/0201539 A1* 7/2016 Tongu ..... B01D 53/9431 422/171
2016/0367940 A1* 12/2016 Lorenz ..... F01N 3/2066
2017/0128884 A1* 5/2017 Goffe ..... C25B 11/02
2018/0328250 A1* 11/2018 Upadhye ..... F01N 3/208
2018/0363530 A1* 12/2018 Caulkins ..... F01N 13/14
2019/0383194 A1* 12/2019 Tummala ..... B01F 25/3133
2020/0040792 A1* 2/2020 Boldt ..... F01N 13/00
2022/0018274 A1* 1/2022 Arunachalam ..... F01N 3/2066
2022/0184567 A1 6/2022 Geant
2023/0065989 A1 3/2023 Geant et al.

* cited by examiner

MIXER ARRANGEMENT FOR MIXING AN INJECTION MEDIUM WITH THE EXHAUST GAS OF AN INTERNAL COMBUSTION ENGINE

CROSS REFERENCE TO RELATED APPLICATION

The present disclosure claims the benefit of a German Patent Application 102023125731.5, filed on Sep. 22, 2023 which is hereby incorporated by reference herein.

TECHNICAL FIELD

The present disclosure relates to a mixer arrangement for mixing an injection medium with the exhaust gas of an internal combustion engine.

BACKGROUND

Reactants are introduced into the exhaust gas flow for the after-treatment of exhaust gases, so that environmentally harmful components in the exhaust gas are reduced. In diesel internal combustion engines, for example, a urea-water solution is injected into the exhaust gas in order to reduce the proportion of nitrogen oxide in the exhaust gas in a downstream SCR catalytic converter arrangement. A mixer arrangement can be arranged upstream of the catalytic converter arrangement, which mixes the reactant injected into the exhaust gas flow with the exhaust gas in order to improve the effectiveness of the catalytic converter.

A mixer arrangement for an internal combustion engine is known from EP 3 808 949 A1, comprising: a base element, wherein a reactant input opening is formed in the base element, which is open in the direction of a radially expanding reactant receiving volume. A mounting arrangement is formed on an outside of the base element, via which a mounting flange of an injector can be fixed to the base element. The mounting arrangement has a flat contact surface for contacting the injector and a plurality of internal threads arranged around the reactant input opening at a circumferential distance from one another. The shape of the contact surface and the positioning of the internal threads are matched to the shape of the mounting flange of the injector.

SUMMARY

It is an object of the present disclosure to provide a mixer arrangement for mixing an injection medium with the exhaust gas of an internal combustion engine, which prevents the injector from overheating.

According to an aspect to the disclosure, a mixer arrangement for mixing an injection medium with the exhaust gas of an internal combustion engine is proposed, comprising an exhaust gas guide section into the interior of which the exhaust gas of the internal combustion engine can be guided, an injector which is mounted to an outside of the exhaust gas guide section, the exhaust gas guide section having an injection opening which extends along an injection axis and through which the injection medium can be injected from the injector into the interior of the exhaust gas guide section, wherein a first recess is formed on the outside of the exhaust gas guide section, and the first recess is in overlap with the injector in a direction parallel to the injection axis and the injector is spaced from the outside of the exhaust gas guide section in this direction.

The mixer arrangement has the advantage that the support surface of the injector, which is in contact with the exhaust gas guide section carrying the hot exhaust gas, is reduced and the surface of the injector, around which ambient air can flow, is increased in return. This means that less thermal energy is transferred from the exhaust gas guide section to the injector and the injector can dissipate the thermal energy to the environment more effectively without the need for additional installation space.

The projection area of the support surface in direction of the injection axis is smaller than the projection area of the entire injector in direction of the injection axis. In other words, the injector overlaps the support surface forming a gap between the overlapping areas of the injector and the outside surface of the exhaust gas guide section.

The first recess is formed as a concave indentation in the outside of the exhaust gas guide section.

In one possible embodiment, the first recess can be open in a direction parallel to the injection axis and away from the exhaust gas guide section. When the injector is installed, for instance in a first installation position, the first recess can extend further in a radial direction in relation to the injection axis than the injector. The first recess can be limited in the axial direction by a bottom surface of the recess. In the radial direction, the first recess can be surrounded by an intermediate shoulder, at least partially. At least one ventilation gap can be formed between the injector and the intermediate shoulder, through which ambient air can flow into the first recess.

In a further possible embodiment, the injector can be mounted to the outside of the exhaust gas guide section in two alternative installation positions, in the first installation position and in the second installation position. A second recess can be formed on the outside of the exhaust gas guide section. The second recess can be arranged in a direction parallel to the injection axis in overlap with the injector in the second installation position. The injector can be spaced from the outside of the exhaust gas guide section in this direction.

In a further possible embodiment, the first recess and the second recess can be designed with mirror symmetry with respect to a mirror plane comprising the injection axis.

BRIEF SUMMARY OF THE DRAWINGS

In the following, an embodiment of a mixer arrangement is explained in more detail with reference to the figures. Herein

DETAILED DESCRIPTION

Figure 1:
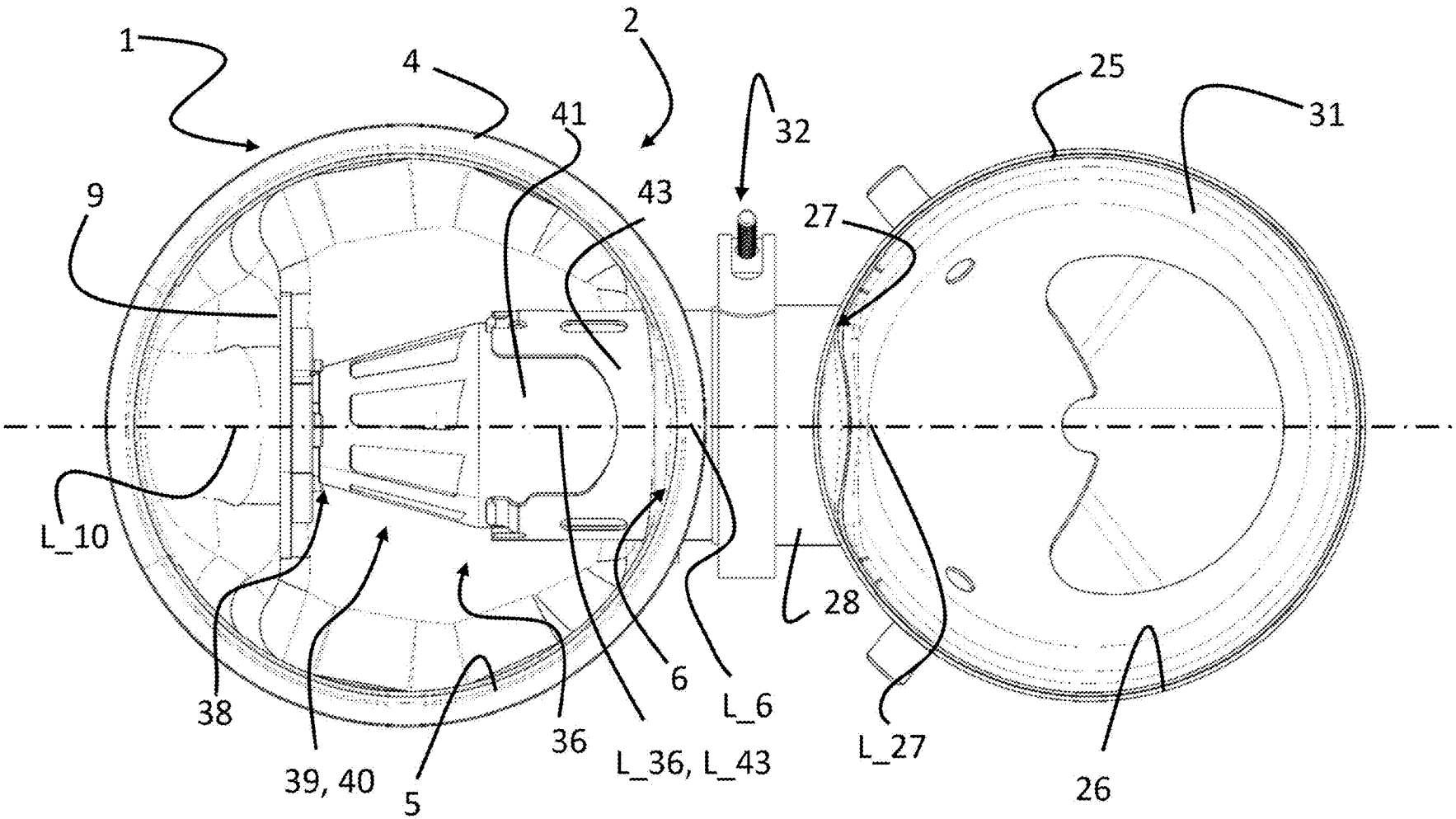
FIG. 1 shows a side view of an exhaust gas aftertreatment arrangement with a mixer arrangement.
Figure 2:
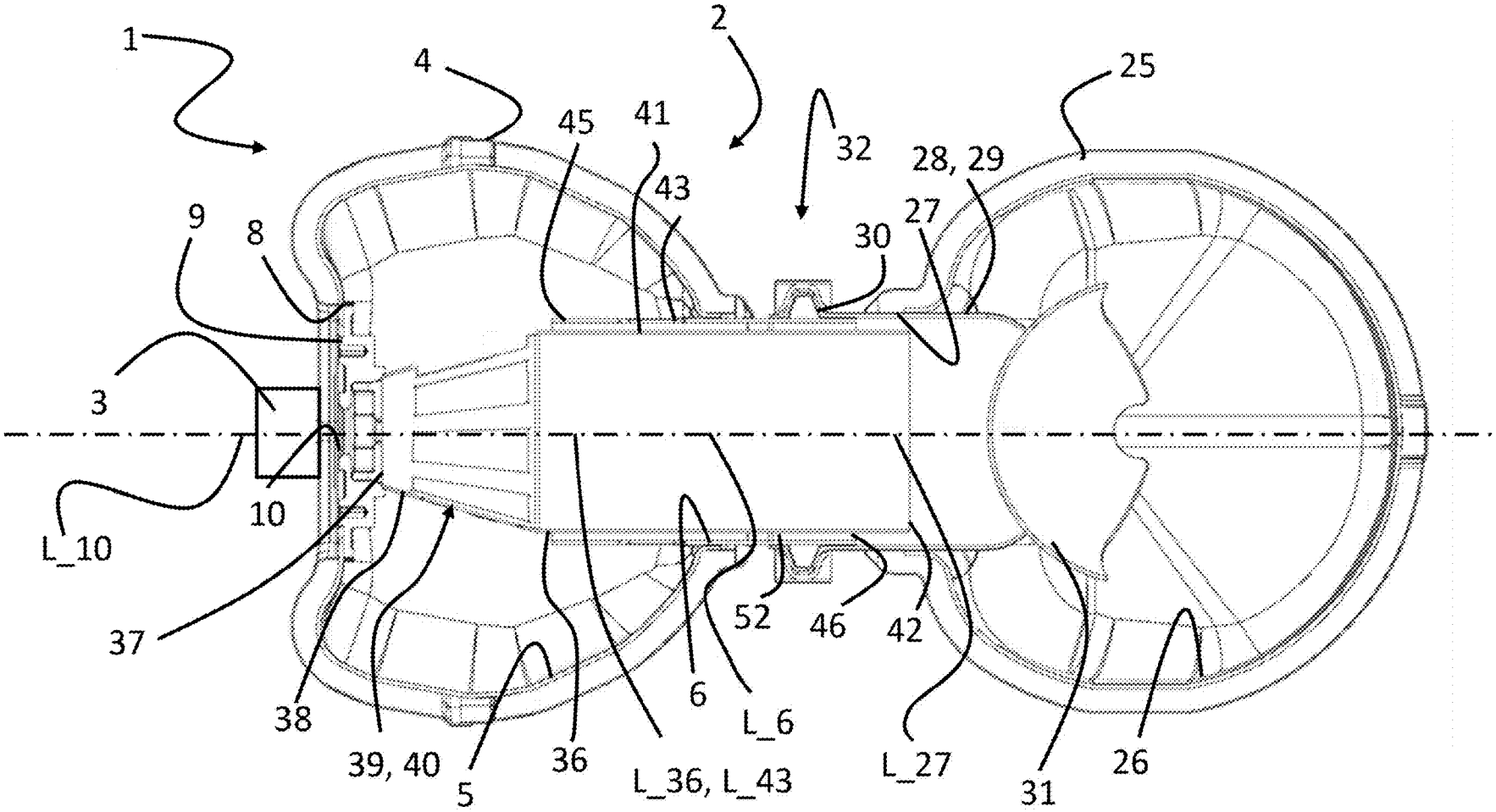
FIG. 2 shows a longitudinal section through the mixer arrangement from FIG. 1.
Figure 3:
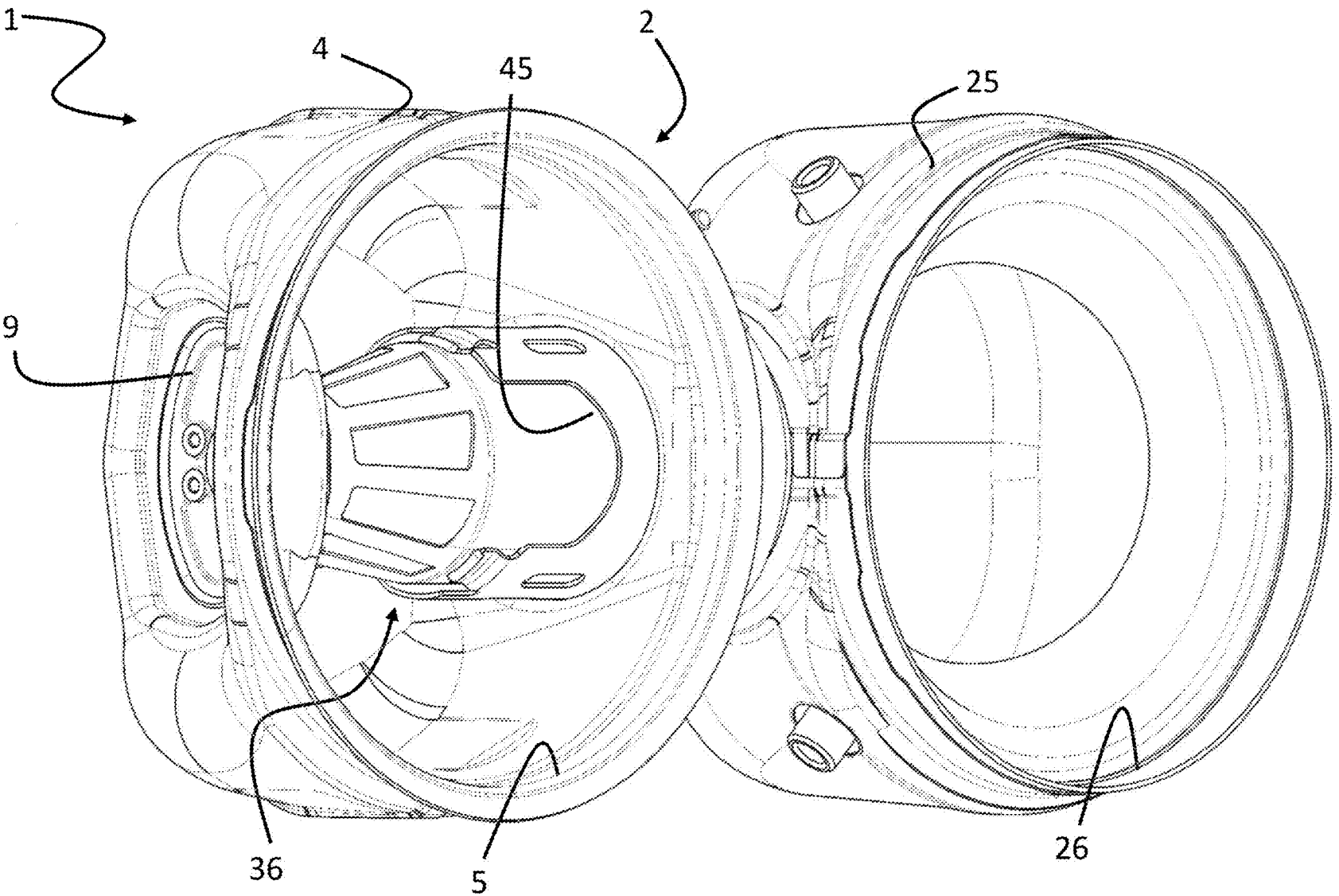
FIG. 3 shows a perspective view of the exhaust gas aftertreatment arrangement from FIG. 1 without injector.
Figure 4:
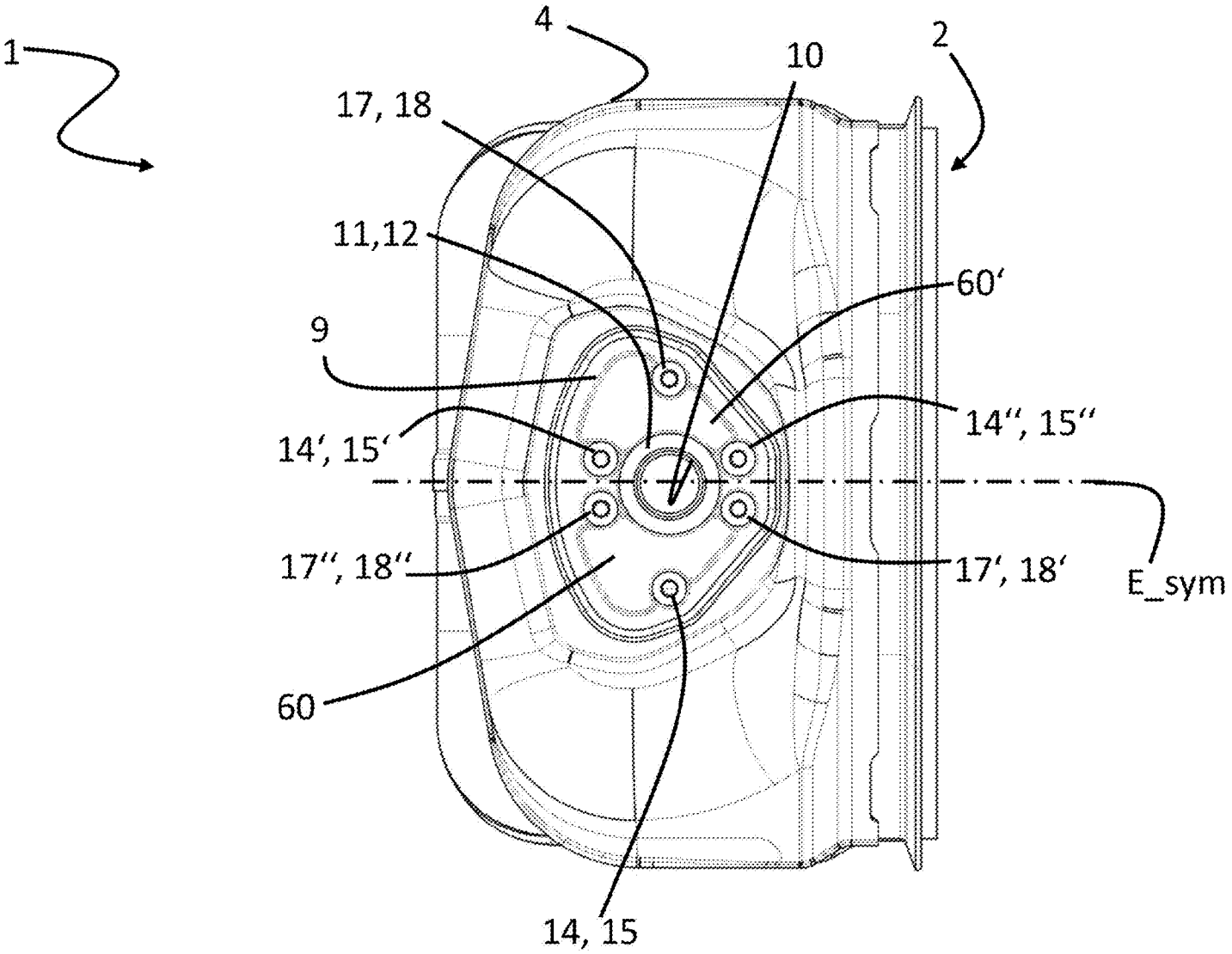
FIG. 4 shows a further side view of the exhaust gas aftertreatment arrangement from FIG. 1 in a first installation position without injector.
Figure 5:
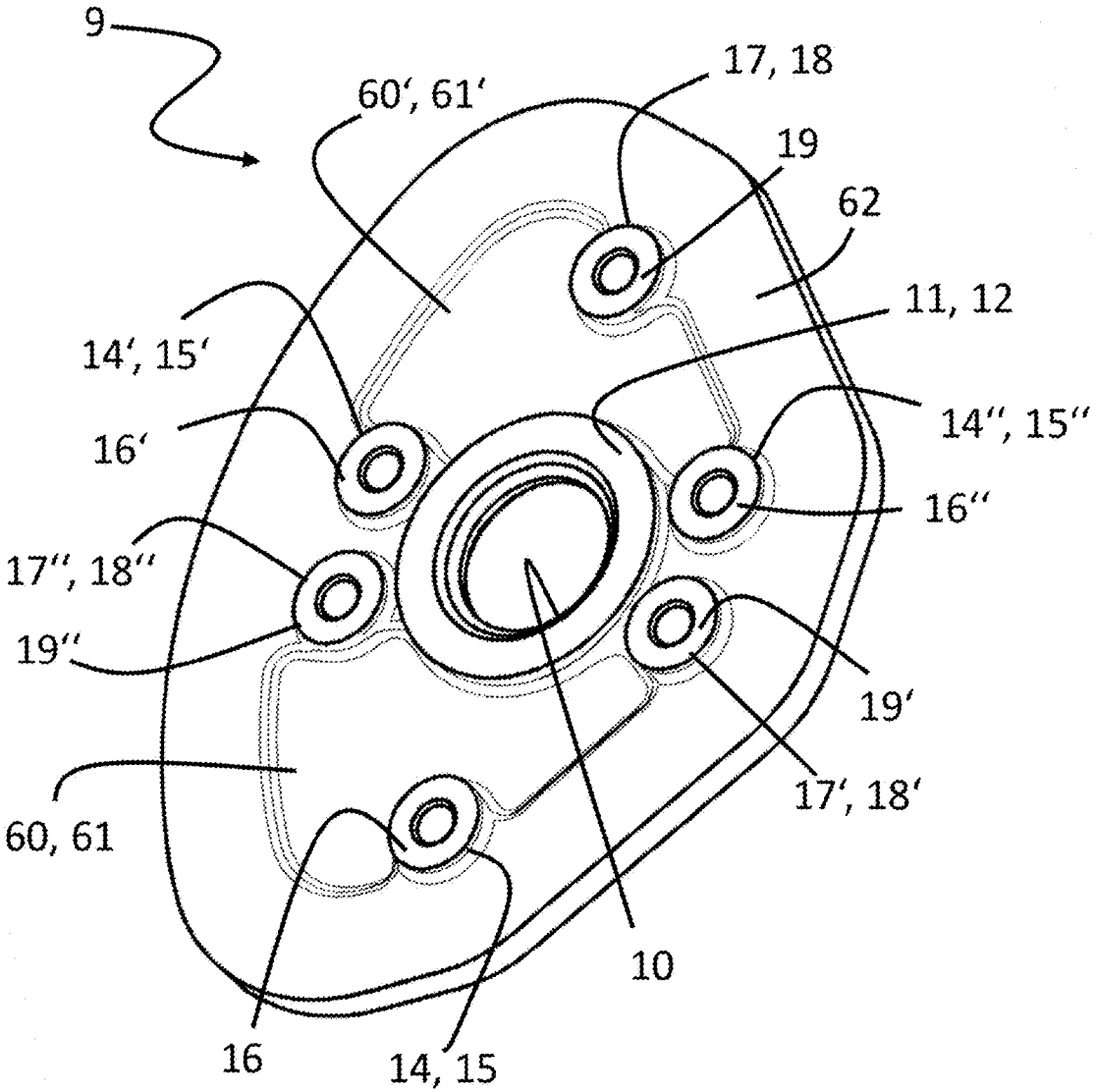
FIG. 5 shows a perspective view of the flange element from FIG. 1.
Figure 6:
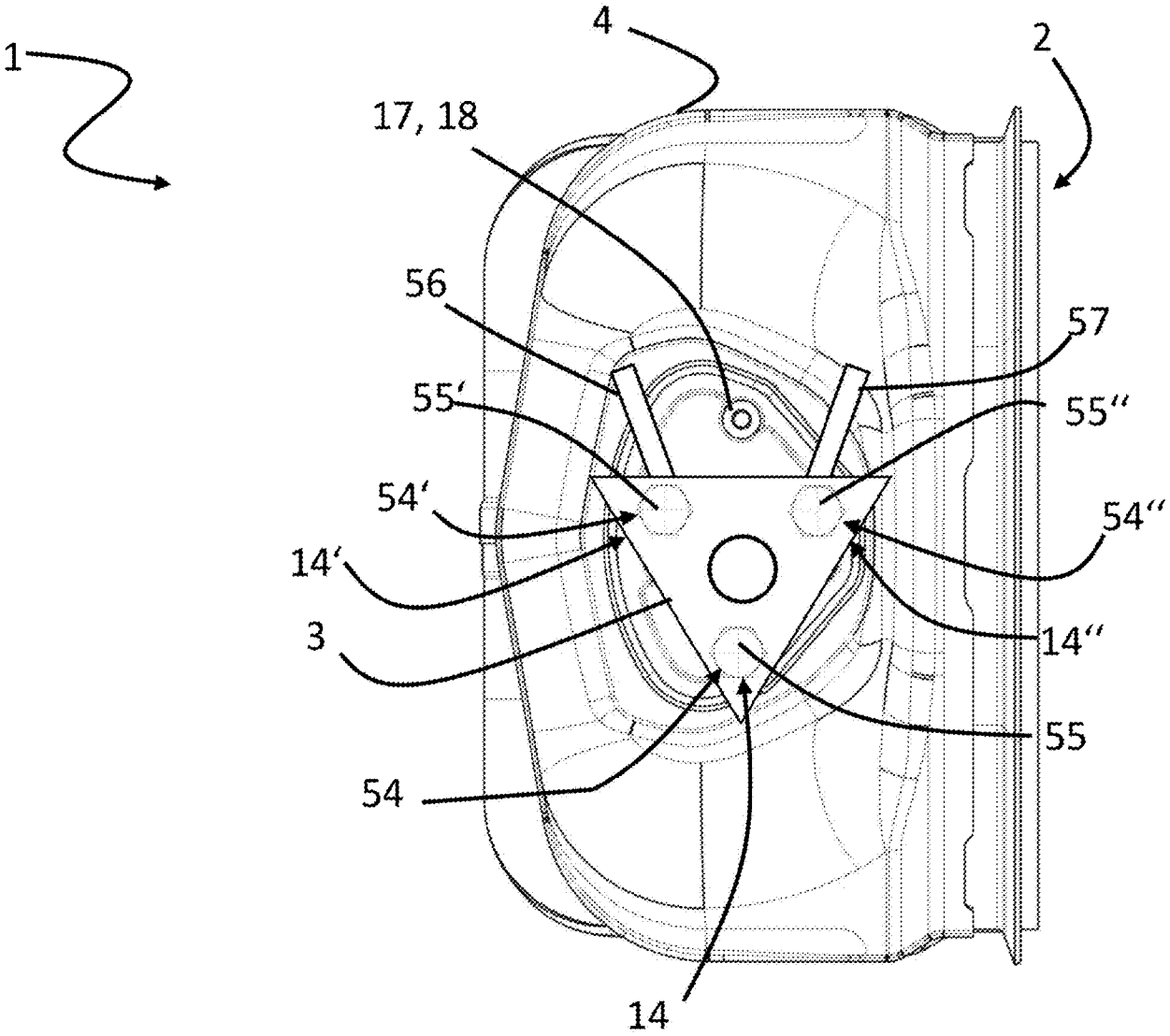
FIG. 6 shows the view from FIG. 4 with the injector mounted in the first installation position.
Figure 7:
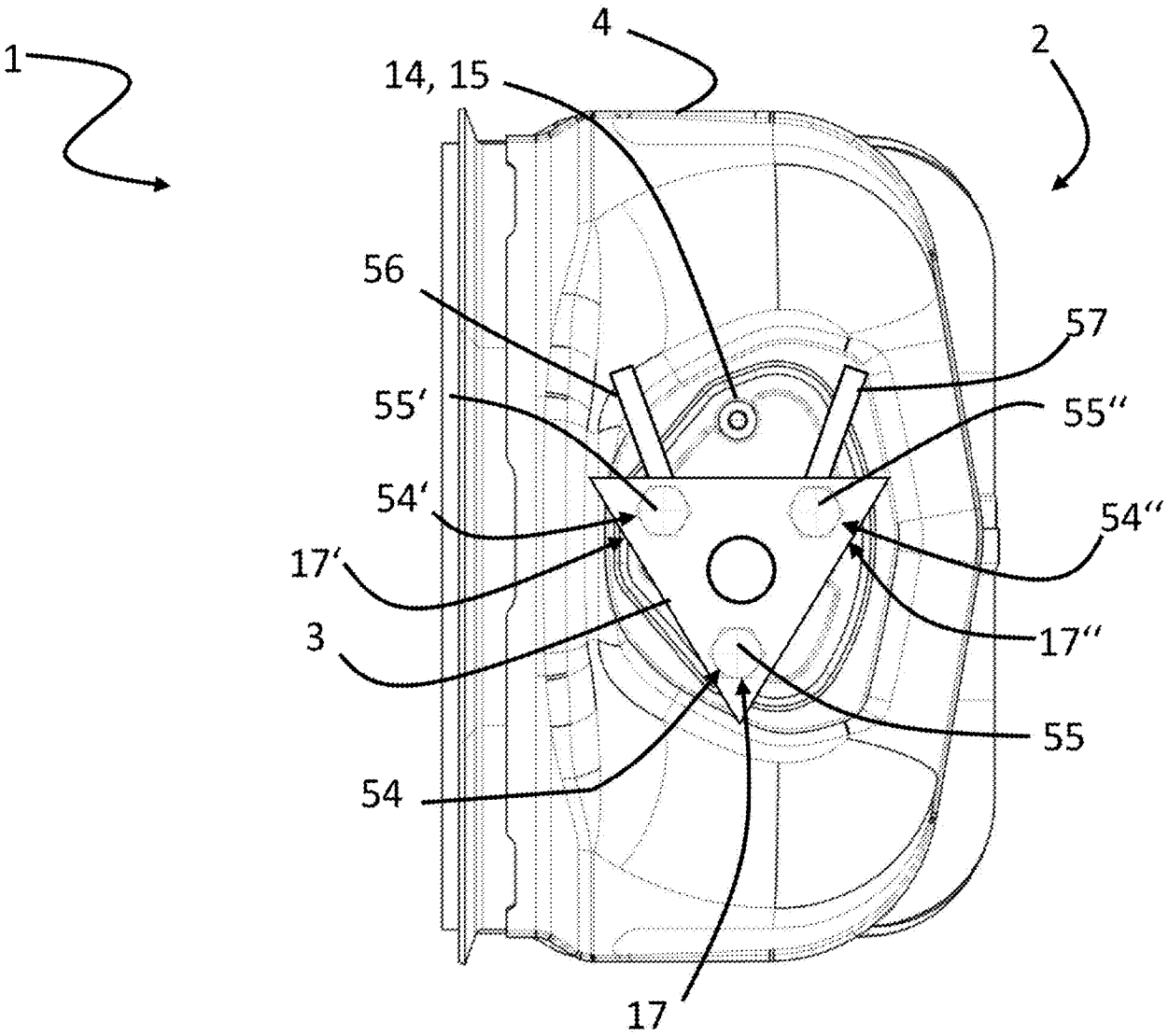
FIG. 7 shows the view from FIG. 4 with the injector mounted in the second installation position.
Figure 8:
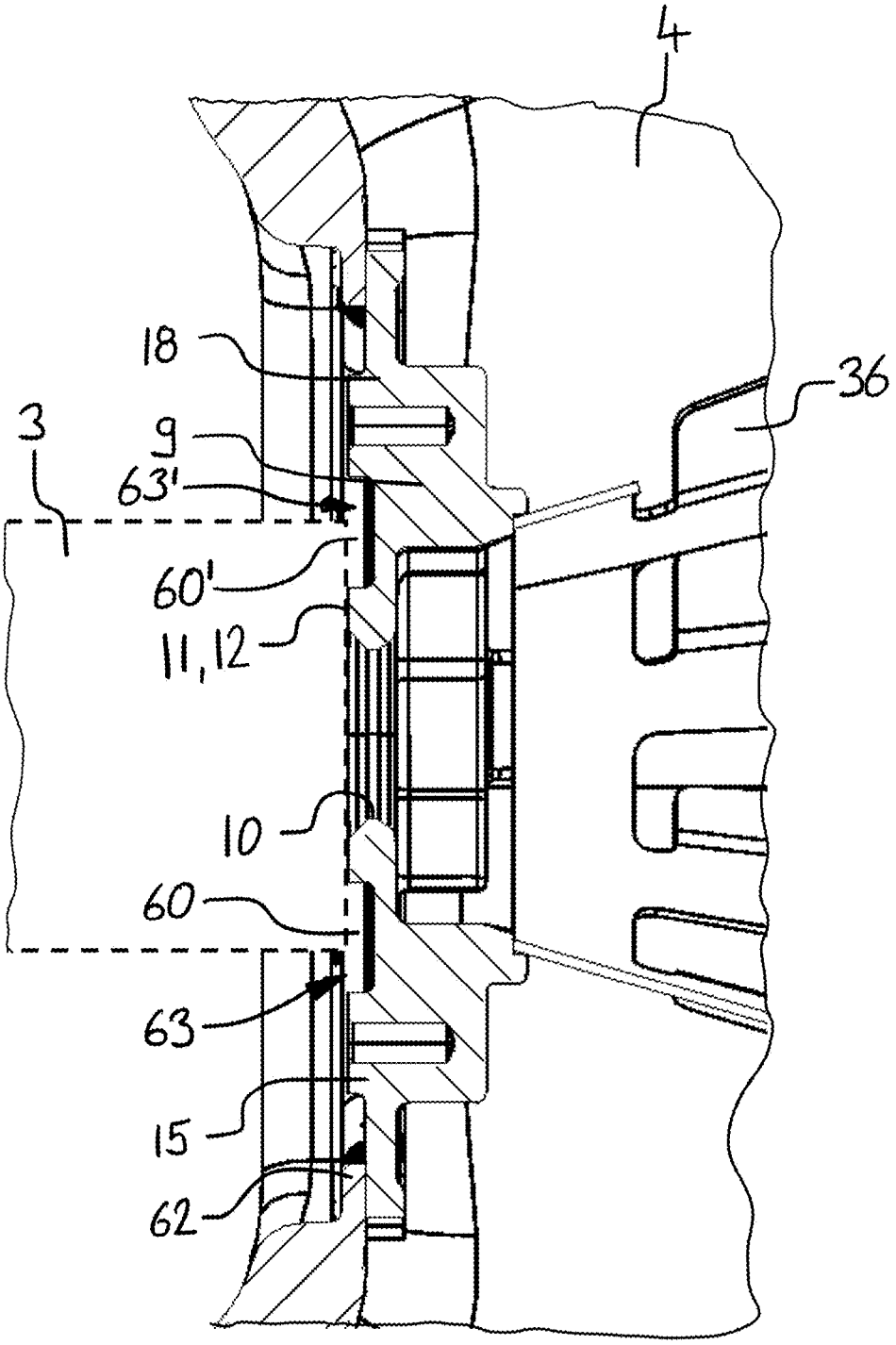
FIG. 8 shows a sectional view of the first exhaust gas guide section in the area of the flange portion.

FIGS. 1 to 7, which are described together below, show a part of an exhaust gas aftertreatment arrangement 1 of an internal combustion engine with a mixer arrangement 2 for mixing an injection medium injectable by an injector 3 with the exhaust gas of the internal combustion engine. In the present case, a water-urea solution is injected into the exhaust gas through the injector 3 as an injection medium and mixed with it to reduce the nitrogen oxide content in the exhaust gas. The exhaust gas is then fed to a catalytic converter, not shown, in which the nitrogen oxides contained in the exhaust gas are converted into water and nitrogen by means of selective catalytic reduction.

The injector 3 is optionally liquid-cooled. For this purpose, the injector 3 is supplied with coolant from a coolant source not shown via a partially shown coolant supply line 56. The coolant flows through the injector 3 and is then returned to the coolant source via a partially illustrated coolant drain 57.

The mixer arrangement 2 comprises a first exhaust gas guide section 4, which can also be referred to as the first exhaust gas guide element. The first exhaust gas guide section 4 is essentially cup-shaped and has a circular connection opening 5, via which the first exhaust gas guide section 4 can be fluidically connected to an upstream section of the exhaust gas aftertreatment arrangement 1, which is not shown. The upstream section of the exhaust gas aftertreatment system 1 can be a particulate filter, for example. The imaginary normal on the connection opening 5 defines the main inflow direction of the exhaust gas into the first exhaust gas guide section 4.

The first exhaust gas guide section 4 also comprises an insert opening 8, in which a flange element 9 is arranged. The first exhaust gas guide section 4 and the flange element 9 are firmly connected to each other, in particular welded. The flange element 9 comprises an injection opening 10, which extends along an injection axis L_10 and via which the injector 3 can inject the injection medium into the interior of the first exhaust gas guide section 4.

For this purpose, the injector 3 is firmly connected to the first exhaust gas guide section 4. For this purpose, the flange element 9 has a mounting arrangement with three first internal threads 14, 14', 14" on an outside facing away from the interior of the first exhaust gas guide section 4, which together form a first threaded hole pattern. The internal threads can also be generally referred to as threaded holes. The three first internal threads 14, 14', 14" are each inserted into an internal threaded socket 15, 15', 15" and extend along a central axis.

The injector 3 has three mounting apertures 54, 54', 54", which together form a mounting hole pattern. The mounting apertures 54, 54', 54" are designed as cylindrical through-holes and can therefore also be referred to as mounting holes.

The first threaded hole pattern of the flange element 9 is complementary to the mounting hole pattern of the injector 3. Thus, the first threaded hole pattern and the mounting hole pattern can be brought into overlap with one another, so that a screw 55, 55', 55" extends through one of the three mounting apertures 54, 54', 54" into one of the three first internal threads 14, 14', 14" and engages therein. The injector 3 is then clamped and frictionally connected to the flange element 9 via three screws 55, 55', 55". This positioning of the injector 3 is carried out in a first installation position of the exhaust gas aftertreatment arrangement 1 and is also referred to as the first installation position of the injector.

The flange element 9 also has three second internal threads 17, 17', 17", which together form a second threaded hole pattern. The second threaded hole pattern is rotationally symmetrical to the first threaded hole pattern with respect to the injection axis L_10. In the present case, the second threaded hole pattern is arranged offset by 180 degrees to the first threaded hole pattern with respect to the injection axis, without being limited to this. The three second internal threads 17, 17', 17" are each inserted into an internal threaded socket 18, 18', 18" and extend along a central axis.

The second threaded hole pattern of the flange element 9 is also complementary to the mounting hole pattern of the injector 3. In this way, the second threaded hole pattern and the mounting hole pattern can be brought into overlap with one another so that a screw 55, 55', 55" extends through one of the three mounting apertures 54, 54', 54" into one of the three second internal threads 17, 17', 17" and engages therein. The injector 3 is then clamped and frictionally connected to the flange element 9 via the three screws 55, 55', 55". This positioning of the injector 3 is carried out in a second installation position of the exhaust gas aftertreatment system 1.

The flange element 9 has bearing surfaces 16, 16', 16" at the axial ends of the internally threaded sockets 15, 15', 15" and support surfaces 19, 19', 19" at the axial ends of the internally threaded sockets 18, 18', 18", which are flat and lie in a common contact plane.

The flange element 9 has a central sealing shoulder 11 that surrounds the injection opening 10 in an annular shape. The sealing shoulder 11 has a sealing surface 12 at its axial end, which lies in the contact plane.

In the first installation position, the support surfaces 16, 16' 16" of the internally threaded sockets 15, 15', 15" together with the sealing surface 12 thus form a contact surface of the flange element 9, on which the injector rests with a complementary contact surface.

In the second installation position, the support surfaces 19, 19', 19" of the internally threaded sockets 18, 18', 18" together with the sealing surface 12 form a contact surface of the flange element 9, on which the injector rests with the complementary designed contact surface.

The injector 3 is thus attached to the outside of the first exhaust gas guide section 4 via the mounting arrangement. A first recess 60 is formed on the outside of the first exhaust gas guide section 4. The first recess 60 is open in a direction parallel to the injection axis L_10 and away from the first exhaust gas guide section 4. In the first installation position, the injector 3 is arranged in a direction parallel to the injection axis L_10 in overlap with at least sections of the first recess 60. The injector 3 is spaced from the outside of the exhaust gas guide section 4 in this direction. A gap is thus formed between the outside of the exhaust gas guide section 4 and the injector 3 in the area of the first recess 60. In other words, the injector 3 has regions which are arranged in axial overlap with the first recess 60, in which regions the injector 3 is spaced from the outside of the exhaust gas guide section 4.

In the first installation position of the injector 3, the first recess 60 extends further in a radial direction with respect to the injection axis L_10 than the injector 3. The outside of the exhaust gas guide section 4 thus has sections in the area of the first recess 60 that are arranged in a direction parallel to the injection axis L_10 without overlapping the injector 3. This allows ambient air to enter the first recess 60 unhindered and flow behind the injector 3 so that thermal energy can be efficiently transferred from the injector 3 to the ambient air.

The first recess 60 is delimited in the axial direction with respect to the injection axis L_10 by a bottom surface 61 and surrounded in the radial direction, at least partially, by an intermediate shoulder 62. At least one ventilation gap 63 is formed between the injector 3 and the intermediate shoulder 62, through which ambient air can flow into the first recess 60. This also allows a flow behind the injector 3 so that thermal energy can be efficiently released from the injector 3 to the ambient air.

A second recess 60' is formed on the outside of the first exhaust gas guide section 4. The second recess 60' is open in a direction parallel to the injection axis L_10 and away from the first exhaust gas guide section 4. In the second installation position, the injector 3 is arranged in a direction parallel to the injection axis L_10 in overlap with at least sections of the second recess 60'. The injector 3 is spaced from the outside of the exhaust gas guide section 4 in this direction. A gap is thus formed between the outside of the exhaust gas guide section 4 and the injector 3 in the area of the second recess 60'. In other words, the injector 3 has regions which are arranged in axial overlap with the second recess 60', in which regions the injector 3 is spaced from the outside of the exhaust gas guide section 4.

In the second installation position of the injector 3, the second recess 60' extends further in a radial direction with respect to the injection axis L_10 than the injector 3. The outside of the exhaust gas guide section 4 thus has sections in the area of the second recess 60' that are arranged in a direction parallel to the injection axis L_10 without overlapping the injector 3. This allows ambient air to enter the second recess 60' unhindered and flow behind the injector 3 so that thermal energy can be efficiently transferred from the injector 3 to the ambient air.

The second recess 60' is delimited in the axial direction with respect to the injection axis L_10 by a bottom surface 61 and surrounded in the radial direction, at least partially, by the intermediate shoulder. At least one ventilation gap 63' is formed between the injector 3 and the intermediate shoulder 62, through which ambient air can flow into the second recess 60'. This also allows a flow behind the injector 3 so that thermal energy can be efficiently released from the injector 3 to the ambient air.

In the first installation position, the injector 3 is arranged in a direction parallel to the injection axis L_10 in overlap with at least sections of the second recess 60'. In the second installation position, the injector 3 is arranged in a direction parallel to the injection axis L_10 in overlap with at least sections of the first recess 60.

The first recess 60 and the second recess 60' are mirror-symmetrical with respect to a mirror plane E_sym, which comprises the injection axis L_10. It is conceivable that the first recess 60 and the second recess 60' are connected to each other via a connection recess.

A mixing pipe 36, which extends along a longitudinal axis L_36, is arranged in the interior of the first exhaust gas guide section 4. The longitudinal axis L_36 is arranged transversely, in particular orthogonally, to the main inflow direction of the exhaust gas in the first exhaust gas guide section 4. The longitudinal axis L_36 is also arranged coaxially to the injection axis L_10. The mixing pipe 36 has an injection opening 37 at a first axial end, which is oriented in the direction of the injection opening 10 of the flange element 9. In other words, the injection opening 37 and the injection opening 10 are opposite each other. The injector 3 thus injects the injection medium into the mixing pipe 36. The mixing pipe 36 engages in recesses of the flange element 9 so that the mixing pipe 36 is supported at the first axial end of the flange element 9 in the axial and radial direction.

The mixing pipe 36 comprises a swirl section 38, which is designed to swirl the exhaust gas flowing through it so that improved mixing of exhaust gas and injection medium can be achieved in the mixing pipe 36. The swirl section 38 extends from the injection opening 37 along the longitudinal axis L_36 and widens conically with increasing distance from the injection opening 37.

In the area of the swirl section 38, the mixing pipe 36 has several inlet openings 39 distributed around the circumference, through which the exhaust gas from the internal combustion engine can enter the mixing pipe 36. In other words, the mixing pipe 36 is fluidically connected to the first exhaust gas guide section 4 via the inlet openings 39. The inlet openings 39 are each delimited in sections by a guide vane 40, which is shaped in such a way that the exhaust gas from the internal combustion engine enters the swirl section 38 with a swirl. The swirl section 38 of the mixing pipe 36 can thus be referred to as mixing arrangement.

A cylinder section 41 adjoins the swirl section 38 in the direction of the longitudinal axis L_36 of the mixing pipe 36. The cylinder section 41 may also be referred to as mixing section. The cylinder section 41 comprises an outlet opening 42 of the mixing pipe 36 at its second axial end.

The cylinder section 41 extends through a passage opening 6 of the first exhaust gas guide section 4, which extends along a passage axis L_6. The passage axis L_6 of the passage opening 6 and the longitudinal axis L_36 of the mixing pipe are arranged coaxially to each other. The cylinder section 41 extends into a second exhaust gas guide section 25, which can also be referred to as the second exhaust gas guide element. The second exhaust gas guide section 25 is arranged downstream of the first exhaust gas guide section 4. The mixing pipe 36 thus fluidically connects the first exhaust gas guide section 4 with the second exhaust gas guide section 25.

The cylinder section 41 is surrounded in sections by a sleeve element 43, which extends along a longitudinal axis L_43. The longitudinal axis L_43 of the sleeve element 43 is arranged coaxially to the longitudinal axis L_36 of the mixing pipe 36. The sleeve element 43 also extends from the interior of the first exhaust gas guide section 4 through the passage opening 6 of the first exhaust gas guide section 4.

A gap 52 is formed between the sleeve element 43 and the mixing pipe 36. The gap 52 extends between an inlet opening 45 and an outlet opening 46, which are each formed between the mixing pipe 36 and the sleeve element 43. The gap 52 is fluidically connected to the first exhaust gas guide section 4 via the inlet opening 45. The gap 52 is fluidically connected to the second exhaust gas guide section 25 via the outlet opening 46. In principle, it is also conceivable that the gap 52 is optionally fluidically connected to the mixing pipe 36.

The gap 52 thus fluidically connects the first exhaust gas guide section 4 with the second exhaust gas guide section 25. The hot exhaust gas from the internal combustion engine can enter the gap 52 from the interior of the first exhaust gas guide section 4 via the inlet opening 45 and flow through it in the direction of the second exhaust gas guide section 25. The hot exhaust gas effectively transfers the thermal energy it contains to the mixing pipe 36 and heats it evenly. This prevents colder spots in the mixing pipe 36 where the injection medium can condense and subsequently deposit.

The mixer arrangement 2 comprises a second exhaust gas guide section 25, which can also be referred to as a second exhaust gas guide element. The second exhaust gas guide section 25 is essentially cup-shaped and has a circular connection opening 26, via which the second exhaust gas guide section 25 can be fluidically connected to a downstream section of the exhaust gas aftertreatment arrangement 1, which is not shown. The downstream section of the exhaust gas aftertreatment system 1 can be an SCR catalytic converter, for example.

The second exhaust gas guide section 25 has a passage opening 27, which extends along a passage axis L_27. The passage axis L_27 of the passage opening 27 and the longitudinal axis L_36 of the mixing pipe 36 are arranged coaxially to one another. A connecting pipe 28 extends along a longitudinal axis L28 through the passage opening 27 of the second exhaust gas guide section 25. The passage axis L_27 of the passage opening 27 and the longitudinal axis L_28 of the connecting pipe 28 are arranged coaxially to each other. The connecting pipe 28 extends from an interior of the second exhaust gas guide section 25 through the passage opening 27. The connecting pipe 28 has a cylindrical section 29 and an adjoining conical section 30, with the conical section 30 forming an axial end of the connecting pipe 28. In the area of the passage opening 27, the cylinder section 29 of the connecting pipe 28 and the second exhaust gas guide section 25 are firmly connected to each other.

The connecting pipe 28 encloses the mixing pipe 36 and the sleeve element 43 at least partially. In other words, the respective axial end of the mixing pipe 36 or the sleeve element 43 arranged outside the interior of the first exhaust gas guide section 4 extends into the connecting pipe 28.

The connecting pipe 28 and the sleeve element 43 are detachably connected to each other by a connecting arrangement 32, so that the connecting pipe 28 and the sleeve element 43 are arranged without contact to each other. The connecting arrangement 32 connects the connecting pipe 28 and the sleeve element 43 in an area outside the first exhaust gas guide section 4 and the second exhaust gas guide section 25.

A baffle plate 31 is arranged in the interior of the second exhaust gas guide section 25, which optimizes the flow of the exhaust gas.

LIST OF REFERENCE SIGNS

1 Exhaust aftertreatment arrangement
2 Mixer arrangement
3 Injector
4 First exhaust gas guide section
5 Connection opening
6 Passage opening
8 Insert opening
9 Flange element
10 Injection opening
11 Central sealing shoulder
12 Sealing surface
14 First thread
15 Threaded socket
16 Support surface
17 Second thread
18 Threaded socket
19 Support surface
25 Second exhaust gas guide section/element
26 Connection opening
27 Passage opening
28 Connecting pipe
29 Cylinder section
30 Conical section
31 Baffle plate
32 Connection arrangement
36 Mixing pipe
37 Injection opening
38 Swirl section
39 Inlet opening
40 Guide vane
41 Cylinder section
42 Outlet opening
43 Sleeve element
45 Inlet opening
46 Outlet opening
52 Gap
54 Mounting aperture
55 Screw
56 Coolant supply line
57 Coolant drain
60 Recess
61 Base surface
62 Intermediate shoulder
63 Ventilation gap
L Axis

What is claimed is:

1. A mixer arrangement for mixing an injection medium with exhaust gas of an internal combustion engine, comprising:

an exhaust gas guide section, in an interior of which the exhaust gas of the internal combustion engine is guidable;

an injector, which is attached to an outside of the exhaust gas guide section alternatively in a first and a second installation position;

an injection opening in the exhaust gas guide section, the injection opening extending along an injection axis and the injection medium is injectable from the injector into the interior of the exhaust gas guide section through the injection opening; and a first recess that is formed on the outside of the exhaust gas guide section, the first recess is arranged in overlap with the injector in the first installation position in a direction parallel to the injection axis and the injector being spaced from the outside of the exhaust gas guide section in this direction forming a gap between the outside of the exhaust gas guide section and the injector, the exhaust gas section including a central sealing shoulder surrounding the injection opening, the central sealing shoulder including a sealing surface for contacting the injector, the exhaust gas section further including an intermediate shoulder spaced radially outward from the central sealing shoulder, the first recess being delimited in an axial direction by a bottom surface and being radially delimited by the central sealing shoulder and the intermediate shoulder, the central sealing shoulder and the intermediate shoulder being spaced in the axial direction from the bottom surface, wherein the injector is mountable to threaded holes of a first threaded hole pattern of a flange of the exhaust gas guide section in the first installation position, and the injector is mountable to threaded holes of a second threaded hole pattern of the flange in the second installation position, and wherein a second recess is formed on the outside of the exhaust gas guide section, the second recess being arranged in overlap with the injector in a direction parallel to the injection axis in the second installation position and the injector being spaced from the outside of the exhaust gas guide section in this direction.

2. The mixer arrangement according to claim 1, wherein the first recess is open in a direction parallel to the injection axis and away from the exhaust gas guide section.

3. The mixer arrangement according to claim 1, wherein first recess extends further in a radial direction with respect to the injection axis than the injector in a mounted condition of the injector.

4. The mixer arrangement according to claim 1, wherein at least one ventilation gap is formed between the injector and the intermediate shoulder, via which ambient air is flowable into the first recess.

5. The mixer arrangement according to claim 1, wherein the first recess and the second recess are configured to be mirror-symmetrical with respect to a mirror plane, which comprises the injection axis.

6. The mixer arrangement according to claim 1, wherein the gap is axially delimited by the injector and the bottom surface and is radially delimited by the central sealing shoulder and the intermediate shoulder.

7. The mixer arrangement according to claim 1, wherein the exhaust gas guide section further includes bearing surfaces at axial ends of internally threaded sockets, the bearing surfaces being spaced in the axial direction from the bottom surface.

8. The mixer arrangement according to claim 7, wherein the bearing surfaces together with the sealing surface form a contact surface of the exhaust gas guide section, on which the injector rests with a complementary contact surface.

9. The mixer arrangement according to claim 1, wherein the exhaust gas guide section further includes at least two bearing surfaces each at an axial end of a respective internally threaded socket, the first recess being between the at least two bearing surfaces.

10. The mixer arrangement according to claim 9, wherein the internally threaded sockets are partially surrounded by the intermediate shoulder.

11. The mixer arrangement according to claim 9, wherein the internally threaded sockets are adjacent to the first recess.

12. The mixer arrangement according to claim 9, wherein the internally threaded socket adjoins the intermediate shoulder.

13. A mixer arrangement for mixing an injection medium with exhaust gas of an internal combustion engine, comprising:

an exhaust gas guide section, in an interior of which the exhaust gas of the internal combustion engine is guidable;

an injector, which is attached to an outside of the exhaust gas guide section alternatively in a first and a second installation position;

an injection opening in the exhaust gas guide section, the injection opening extending along an injection axis and the injection medium is injectable from the injector into the interior of the exhaust gas guide section through the injection opening; and a first recess that is formed on the outside of the exhaust gas guide section, the first recess is arranged in overlap with the injector in the first installation position in a direction parallel to the injection axis and the injector being spaced from the outside of the exhaust gas guide section in this direction forming a gap between the outside of the exhaust gas guide section and the injector, the first recess being delimited in an axial direction by a bottom surface and being surrounded in a radial direction, at least partially, by an intermediate shoulder, the exhaust gas guide section further including bearing surfaces at axial ends of internally threaded sockets, the bearing surfaces being spaced in the axial direction from the bottom surface, wherein the injector is mountable to threaded holes of a first threaded hole pattern of a flange of the exhaust gas guide section in the first installation position, and the injector is mountable to threaded holes of a second threaded hole pattern of the flange in the second installation position, and wherein a second recess is formed on the outside of the exhaust gas guide section, the second recess being arranged in overlap with the injector in a direction parallel to the injection axis in the second installation position and the injector being spaced from the outside of the exhaust gas guide section in this direction.

14. The mixer arrangement according to claim 13, wherein the internally threaded sockets are partially surrounded by the intermediate shoulder.

15. The mixer arrangement according to claim 13, wherein the bearing surfaces together define a triangle.

16. A mixer arrangement for mixing an injection medium with exhaust gas of an internal combustion engine, comprising:

an exhaust gas guide section, in an interior of which the exhaust gas of the internal combustion engine is guidable;

an injector, which is attached to an outside of the exhaust gas guide section alternatively in a first and a second installation position;

an injection opening in the exhaust gas guide section, the injection opening extending along an injection axis and the injection medium is injectable from the injector into the interior of the exhaust gas guide section through the injection opening; and a first recess that is formed on the outside of the exhaust gas guide section, the first recess is arranged in overlap with the injector in the first installation position in a direction parallel to the injection axis and the injector being spaced from the outside of the exhaust gas guide section in this direction forming a gap between the outside of the exhaust gas guide section and the injector, the exhaust gas guide section further including at least two bearing surfaces each at an axial end of a respective internally threaded socket, the first recess being between the at least two bearing surfaces, wherein the injector is mountable to threaded holes of a first threaded hole pattern of a flange of the exhaust gas guide section in the first installation position, and the injector is mountable to threaded holes of a second threaded hole pattern of the flange in the second installation position, and wherein a second recess is formed on the outside of the exhaust gas guide section, the second recess being arranged in overlap with the injector in a direction parallel to the injection axis in the second installation position and the injector being spaced from the outside of the exhaust gas guide section in this direction.

17. The mixer arrangement according to claim 16, wherein the internally threaded sockets are adjacent to the first recess.

18. The mixer arrangement according to claim 17, the first recess being delimited in an axial direction by a bottom surface and being surrounded in a radial direction, at least partially, by an intermediate shoulder, the internally threaded socket adjoining the intermediate shoulder.

* * * * *